US006206371B1

(12) United States Patent
Dove

(10) Patent No.: US 6,206,371 B1
(45) Date of Patent: Mar. 27, 2001

(54) DEVICE FOR "FLIPPING A COIN", OR THE LIKE

(76) Inventor: John Dove, 26 Larch Crescent, Beeston, Nottingham NG9 4DL (GB)

( * ) Notice: Subject to any disclaimer, the term of this patent is extended or adjusted under 35 U.S.C. 154(b) by 0 days.

(21) Appl. No.: 09/269,326

(22) PCT Filed: Aug. 25, 1997

(86) PCT No.: PCT/GB97/02609

§ 371 Date: May 14, 1999

§ 102(e) Date: May 14, 1999

(87) PCT Pub. No.: WO98/13115

PCT Pub. Date: Apr. 2, 1998

(30) Foreign Application Priority Data

Sep. 26, 1996 (GB) ..... 9620034

(51) Int. Cl.[7] ..... A63B 71/00
(52) U.S. Cl. ..... 273/144 R
(58) Field of Search ..... 273/144 R, 145 A, 273/145 B, 145 C, 145 CA, 145 D, 145 R, 138.2, 138.1, 138.3; 446/140, 130, 484

(56) References Cited

U.S. PATENT DOCUMENTS

| | | | | |
|---|---|---|---|---|
| 60,421 | * | 12/1866 | Quincy | 273/120 |
| 148,374 | * | 3/1874 | Mains | 273/145 |
| 178,537 | * | 6/1876 | Macintire | 273/145 |
| 497,314 | * | 5/1893 | French | 273/145 |
| 503,403 | * | 8/1893 | Brinkman | 273/145 |
| 1,353,380 | * | 9/1920 | Church | 237/145 |
| 1,554,633 | * | 9/1925 | Ingram | 273/145 |
| 1,766,134 | * | 6/1930 | Lauterbach | 273/145 |
| 1,882,294 | * | 10/1932 | Mulvey | 46/233 |
| 2,462,686 | * | 2/1949 | Stallard | 273/145 |
| 2,791,432 | * | 5/1957 | Alvernaz | 273/145 |
| 3,084,478 | * | 4/1963 | Burger | 46/233 |
| 3,173,691 | * | 3/1965 | Kunneke | 273/120 |
| 4,049,277 | * | 9/1977 | Carlsson, Jr. et al. | 273/145 |
| 4,993,986 | * | 2/1991 | Bloomfield | 446/140 |
| 5,100,141 | * | 3/1992 | Fitch | 273/145 B |
| 5,393,060 | | 2/1995 | Land et al. . | |
| 5,683,284 | * | 11/1997 | Christen | 446/233 |

FOREIGN PATENT DOCUMENTS

| | | |
|---|---|---|
| 33 09 817 | 9/1984 | (DE) . |
| 296 01 152 U | 4/1996 | (DE) . |
| 0 426 301 | 5/1991 | (EP) . |
| 0 527 324 | 2/1993 | (EP) . |
| 0 615 775 | 9/1994 | (EP) . |
| 08215423 | 8/1996 | (JP) . |

* cited by examiner

*Primary Examiner*—Sebastiano Passaniti
*Assistant Examiner*—D Collins
(74) *Attorney, Agent, or Firm*—Marshall, O'Toole, Gerstein, Murray & Borun

(57) ABSTRACT

A device for carrying out the operation of "flipping a coin" or "throwing dice" comprises a base on which a coin can rest in a number of stable orientations. An electromagnet projects the coin above the base and a sensor detects the orientation in which the coin comes to rest on the base.

17 Claims, 3 Drawing Sheets

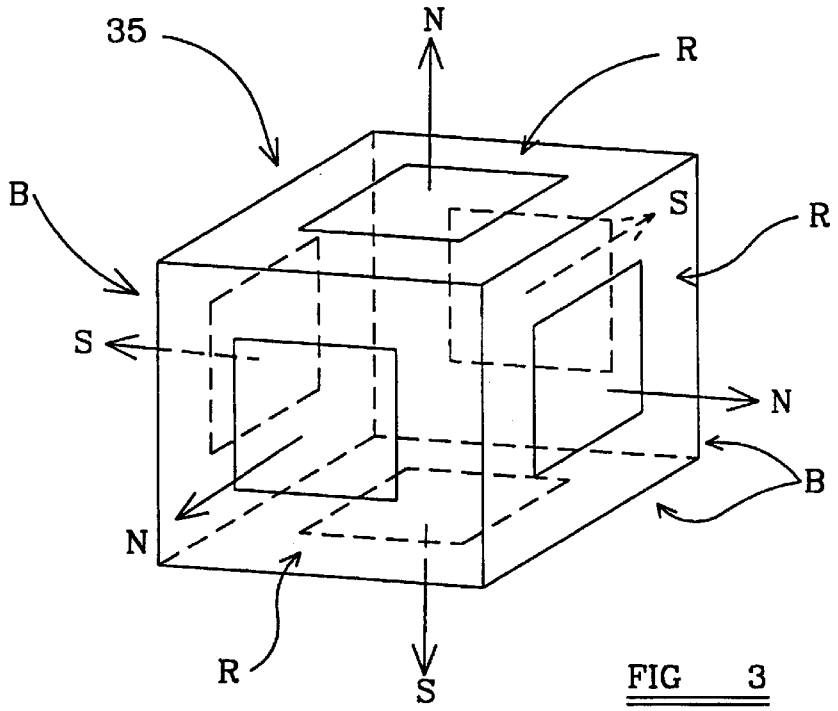
FIG 3
FIG 4A
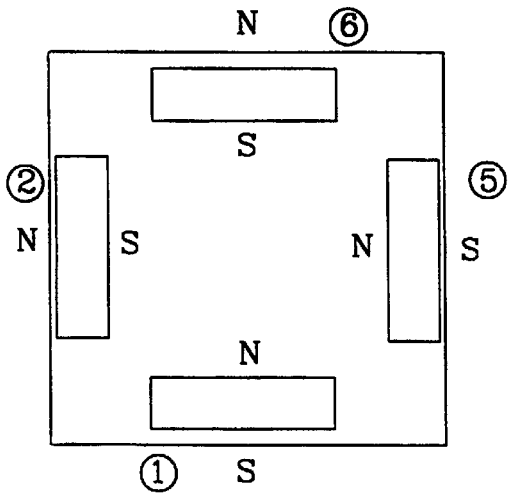
FIG 4B
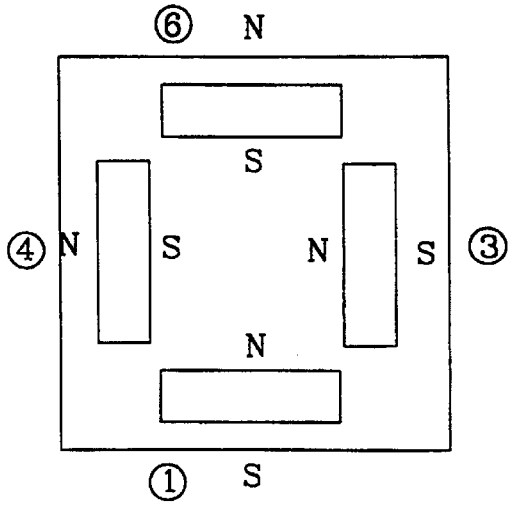

DEVICE FOR "FLIPPING A COIN", OR THE LIKE

BACKGROUND OF THE INVENTION

This invention relates to a device for carrying out an operation which may generate a random indication by projecting an indicator member into the air and, when it lands, detecting its orientation. Such an operation may be carried out for amusement, gambling or other purposes, and may be that which is commonly referred to as "flipping (or tossing) a coin", or "throwing dice".

Flipping a coin has long been known as an activity which theoretically produces an unpredictable result and thus can be used as a random input parameter in activities such as, for example, decision taking, sports, games, gambling, or the like. A coin or coin-like member is projected into the air in such a way that it spins or tumbles in the air, and when it lands it is inspected to see if its obverse or reverse side is uppermost. In the throwing of dice, a die is used in the form of a cube and its six faces bear different numbers or other indications. Such a die is projected such that it tumbles in the air and/or on a surface whereon it lands, and when it comes to rest the face which is uppermost provides the (theoretically) random indication to be used in the game or whatever. In the past, however, these have essentially been operations carried out manually by a person, and have not been able to be automated in a simple and economical manner. However, if such automation could be achieved it would enable such an operation to be incorporated as an operative feature of amusement or gaming machines. It is broadly the object of the present invention to meet this requirement.

SUMMARY OF THE INVENTION

According to the present invention, I provide a device comprising a base whereon an indicator member can rest; electromagnetic means for projecting the indicator member above the base; and means for detecting the orientation in which the indicator member comes to rest on the base.

Whilst it is possible by electro-magnetic induction to cause an element of non-ferrous metal to be projected above an electro-magnet, preferably the indicator member is or carries at least one permanent magnet element. It may be a coin member, i.e. have the appearance of a standard coin which is or has been currency in any particular country where the device is to be used, or otherwise is well known, or alternatively it may have the appearance of a coin-like token. Further alternatively, it could be of some other form which is able to rest on a base in one of two or more stable orientations, for example a cube and it may then be a die.

For example, a coin made of non-ferrous material may be machined out in order to receive an appropriately dimensioned permanent magnet element. By way of example, a coin such as a British two-pence piece could have its centre machined to accommodate a neodymium-iron-boron permanent magnet of approximate dimensions of 15 mm diameter and 1 mm thickness. Two such coins could be machined respectively on their obverse and reverse sides to be able to be assembled together with such a permanent magnetic element therebetween, and resemble a standard such coin.

Preferably the electro-magnetic means for projecting the indicator member above the base comprises an electrically energisable coil having a magnetic core with an end portion disposed in or closely beneath said base.

When electrically energised, the effect is to produce a magnetic field which preferably is concentrated at a selected point on the base by having the end portion of the core of tapering configuration. When the coil is energised in the appropriate sense, depending on the orientation of the indicator member on the base, the effect is to project the indicator member above the base by magnetic repulsion.

Preferably said base is of upwardly facing concave configuration, and said core end portion lies at or adjacent a lowermost part thereof so that in the absence of any external influence the indicator member will tend to fall to lie in alignment with said core.

Preferably the device comprises means for constraining the indicator member when it is projected above the base, so that it will always land on the base and not escape.

The means for constraining the indicator member may comprise a wall or walls, preferably at least partially transparent so that the indicator member can be observed, extending upwardly from said base.

There may be a cover member to prevent the indicator member from travelling above an uppermost part of the wall or walls or alternatively the wall or walls could extend upwardly to a distance beyond that to which one can expect the indicator member to be upwardly projected in use.

The means for detecting the orientation of the indicator member when resting on the base preferably comprises means for detecting the polarity of the permanent magnetic field of the indicator member. Conveniently this may be achieved by a Hall effect sensor, which may be disposed in association with the core of the coil. The strength of the field may also be sensed, and such sensing may, as described hereafter, be used to detect the orientation of an indicator member which is capable of resting in more than two stable orientations.

The device preferably further comprises electric circuit means for causing the coil to be electrically energised in the appropriate sense and sufficiently strongly to cause the indicator member to be projected above the base by magnetic repulsion upon such energisation, in accordance with the detected orientation of the indicator member when resting on the base prior to such projection.

After the coil has been thus energised, it may be completely de-energised so that the indicator member falls randomly, uninfluenced by external magnetic forces.

Alternatively, the electric circuit means may provide for energisation of the coil subsequent to projection of the indicator member, in such a way as to influence the way in which the indicator member orientates itself on landing.

The device may be adapted for incorporation in a gaming or amusement machine, and appropriate electronic circuitry may be provided to interface as required with a microprocessor controller of such a machine.

BRIEF DESCRIPTION OF THE DRAWINGS

The invention will now be described by way of example with reference to the accompanying drawings, of which:

FIG. 3 is a diagrammatic perspective view of an indicator member in the form of a cube, for use in the invention;

FIG. 4 diagrammatically illustrates an indicator member in the form of a die for use in the invention.

DETAILED DESCRIPTION

Figure 1:
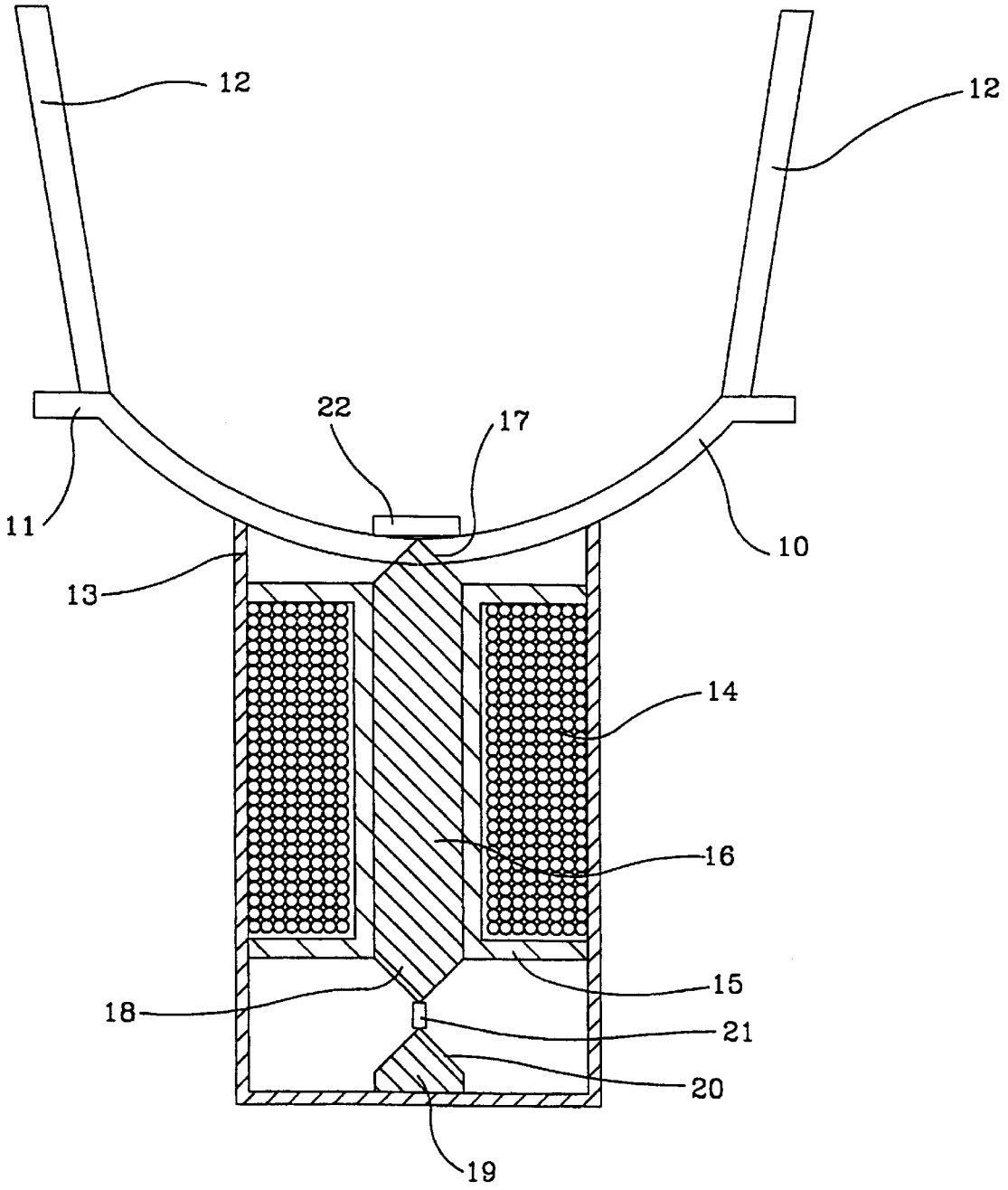
FIG. 1 is a diagrammatic side elevation of a device in accordance with the invention.

Referring firstly to FIG. 1 of the drawings, there is shown a device for carrying out the operation of "flipping a coin".

The device comprises a base 10 which is in the form of a shallow upwardly concave dish with a peripheral rim 11. The form of the base is generally that of part of a spherical shell, but it will be appreciated that it could be of other configuration, for example frusto-conical. The base 10 is conveniently of plastics material.

From the peripheral rim 11 of the base there extends upwardly a wall 12 which defines a constraining volume extending upwardly from the base. The wall 12 extends to a height slightly above that to which a coin can be expected to be projected in use of the apparatus, and preferably is closed at its top by a cover, not shown. The wall 12 or a part of it is transparent so that the flipping of a coin by the device can be observed.

Beneath the base 10 there is disposed a casing 13 wherein there is mounted a coil 14 of a plurality of turns of electrical wire on a former 15. A core 16 is disposed within the former 15 and is of iron or other appropriate material. The core 16 has an upper conically tapered end portion 17 whose tip lies flush with the upper surface of the base 10 at its lowest point, or just below such surface. The core further has a lower conically tapered end portion 18.

At the bottom of casing 13 there is an upwardly extending core member 19 in the form of, for example, an iron rod, having at its upper end a conically tapering end portion 20. This faces the lowermost point of the end portion 18 of the core 16, and between these two components there is disposed a Hall effect sensor 21.

In FIG. 1 there is shown lying on the lowermost part of the base 10, just above the top of the core 16, a coin or coin-like indicator member 22. The coin 22 is either of a permanent magnet material or contains an element of such material, arranged in such a way that the obverse side of the coin is the north-seeking magnetic pole and the reverse side the south-seeking pole, or vice versa. By way of example, a coin of non-magnetic material may be machined out to receive a permanent magnet element, as above referred to.

It will be apparent that if the coil 14 is electrically energised in the appropriate sense, it will produce a magnetic field which, by magnetic repulsion, will project the coin 22 upwardly from the base 10. It will further be apparent that when the coin is lying above the core 16, with the coil 14 de-energised, a magnetic field will be induced in the core whose orientation will depend on whether it is the obverse or the reverse side of the coin which is uppermost, and that the orientation of the magnetic field can be detected by the Hall effect sensor 21 to provide an output signal indicative of which way up the coin has landed. This signal can be used to ensure that when the coil is energised to project the coin, such energisation is done in the correct sense.

It is envisaged that a device as above described will be incorporated in an amusement or gaming machine. In its simplest form, such a machine may use the flipping of a coin as the prime basis of play. Otherwise the flipping of the coin could be a feature incorporated as an addition to a machine having some other principal basis for playing.

Figure 2A:
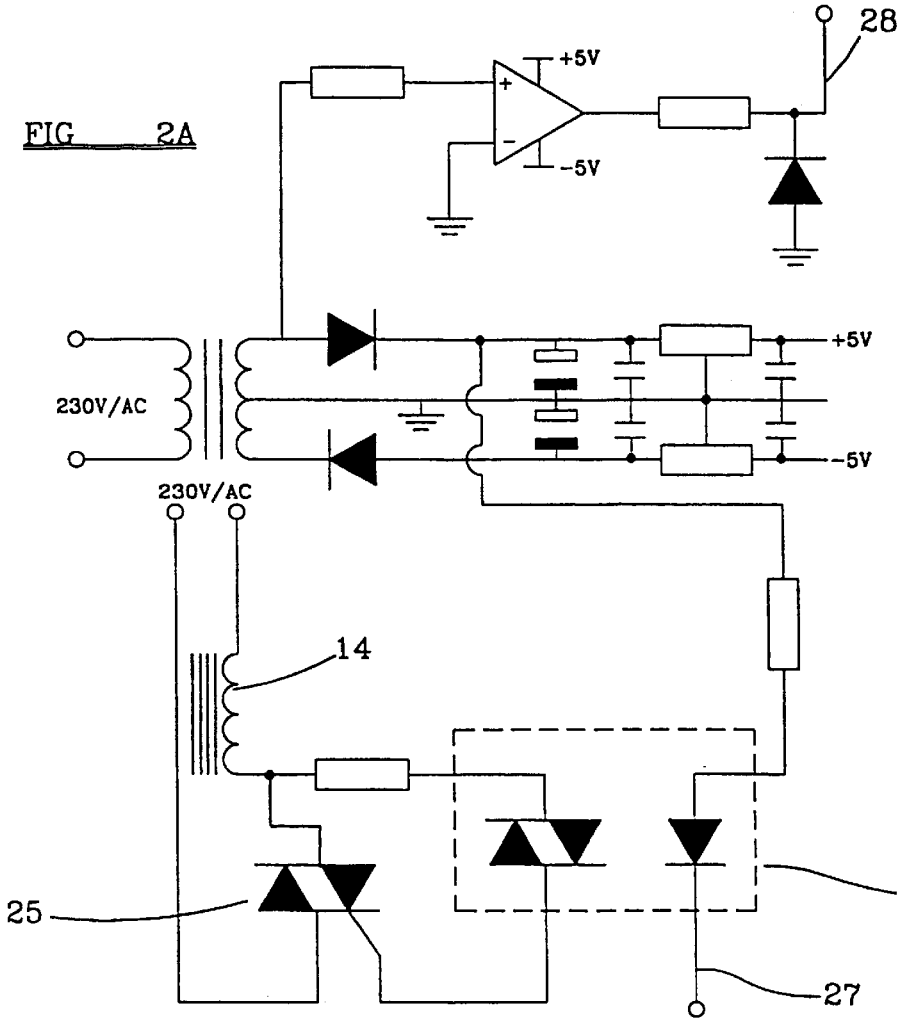
FIG. 2 shows certain electronic circuit elements which may be provided in association with the device.
Figure 2B:
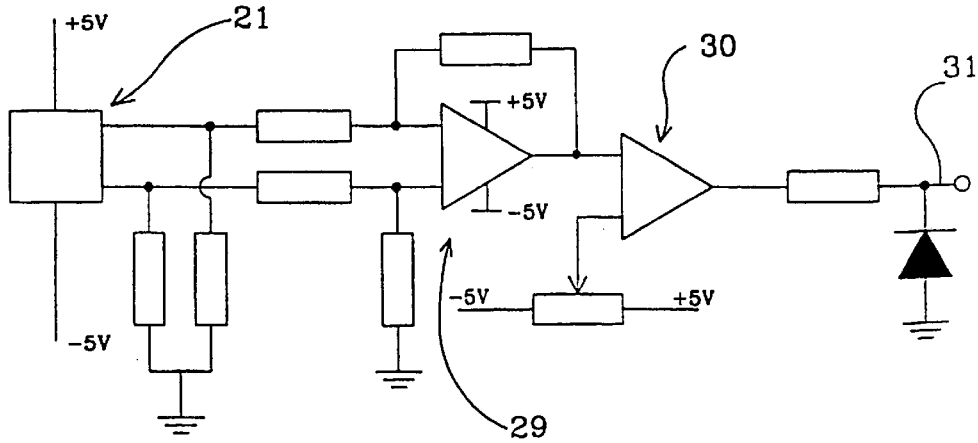

Referring now to FIGS. 2A and 2B of the drawings, certain circuit elements which may be used in control and operation of the device are illustrated. However, it will be appreciated that it would be within the scope of the person skilled in the art to design other electrical circuits for such operation and control. Accordingly, although the illustrated circuit elements are preferred examples of those which may be utilised, they are not essential to the broadest aspect of the present invention.

FIG. 2A shows the coil 14, arranged in a circuit whereby it can be connected directly to a mains electricity supply (230 Volts AC in the UK) by way of a triac 25. The triac 25 is able to be fired by another triac 26 containing an opto-isolator. The opto-isolated triac 26 is connected directly to an available open collector output at 27, on a gaming or amusement machine in which the device is installed. FIG. 2A further shows a circuit which produces at 28 a digital signal which switches in synchronisation with the zero crossover of the alternating current mains electrical supply. This crossover signal output would be connected to an input to the controller of the machine in which the device is incorporated.

FIG. 2B shows a circuit in which the Hall effect sensor 21 is shown, and wherein the analogue output signal from the Hall effect sensor is passed through a differential amplifier 29 to a calibrated voltage comparator 30 which produces a digital output indicating the orientation of the coin. This output, at 31, can be connected to an available input on the microprocessor controller of the machine in which the device is installed.

The controller of the host machine can now determine the polarity of the coin, and cause the triac 25 to be fired at the correct moment in the cycle of the alternating current power supply, to energise the electromagnet coil 14 to produce a polarised magnetic field that repels the coin. Thus the coin is projected upwardly away from the base 10 and the coil 14 therebeneath.

If the coil 14 is then de-energised, while the coin is still travelling upwardly, the coin can fall and bounce around within the space defined by base 10 and walls 12, eventually settling in the centre of the base in a randomly created orientation.

In an alternative mode of operation, however, the coil 14 can continue to be energised at the appropriate moments during the cycle of the alternating current power supply, to create a polarised magnetic field above the base 10 which will influence the orientation in which the coin falls and settles on the base. Thus the device can operate in an uncontrolled and random manner, or in such a way as to produce a result which is controllable to a greater or lesser extent.

A further possibility is that the coin could be made, by appropriate energisation of the coil 14, to spin on its edge while in contact with the base.

The invention has been described above in relation to the flipping of an indicator member which is a coin or coin-like member, e.g. a token of some sort. In most cultures of the world, a coin or the like is the item which most commonly is tossed or flipped to provide a random heads/tails result. However, it will be appreciated that objects other than coins or tokens could equally well be flipped by the device.

In particular, an indicator member may be utilised which is capable of coming to rest in more than two stable orientations. Such an indicator member may be in the form of a cube, which has six faces upon each of which it is capable of resting stably, and such faces may be differently coloured, numbered, or otherwise characterised to distinguish them from one another. A cubic die whose faces bear the numbers 1 to 6, usually in the form of the appropriate number of spots is, of course, commonly used in games, and the invention provides for the operation usually termed "throwing dice" to be carried out.

Referring now to FIG. 3 of the drawings, this shows an indicator member 35 in the form of a cube whose surfaces are coloured, three in one colour and three in another, e.g.

black and red. The surfaces which are coloured red are indicated by R, and those which are coloured black indicated by B. Permanent magnet elements are set in the cube beneath the surfaces thereof, and the polarity of such magnet elements is as indicated by the arrows N and S. Although the cube can rest in six orientations, the indication it provides is one of only two possible indications, and is detected by the polarity of the magnet element which is lowermost when the cube comes to rest.

A cubic indicator member in the form of a die, bearing numbers 1 to 6 on its faces, is, of course, capable of resting in six stable orientations and such orientations may be identified by arranging for the six faces to have different magnetic field strengths as well as polarities. Such different field strengths may be provided by disposing permanent magnet elements which inherently have different field strengths from one another at the surfaces of the indicator member. A further possibility is that permanent magnet elements of the same strength as one another may be disposed at different spacings beneath the respective faces of the indicator member.

By way of example, FIG. 4 shows in a front view (FIG. 4A) and a side view (FIG. 4B) an indicator member in the form of a die with permanent magnet elements of the same strength as one another disposed at different distances beneath the surfaces of the die. It will be noted that the magnet elements adjacent the surfaces bearing the numbers 2 and 5 are closest to such surfaces, while the magnet elements adjacent the surfaces bearing the numbers 4 and 3 are furthest away from such surfaces. The magnet elements adjacent the surfaces bearing the numbers 1 and 6 are an intermediate distance from such surfaces. Thus the surfaces have magnetic poles and field strengths as follows, a field strength 3 being the strongest and a field strength 1 the weakest:

| | |
|---|---|
| Die Surface 2 North Pole | (field strength 3 at surface of base |
| Die Surface 1 South Pole | (field strength 2 at surface of base) |
| Die Surface 4 North Pole | (field strength 1 at surface of base) |
| Die Surface 5 South Pole | (field strength 3 at surface of base) |
| Die Surface 6 North Pole | (field strength 2 at surface of base) |
| Die Surface 3 South Pole | (field strength 1 at surface of base) |

In an electrical circuit for use in control and operation of a device in accordance with the invention, a Hall effect sensor gives an indication of field strength as well as magnetic polarity. The circuit would incorporate the necessary additional element or elements to enable it to communicate a quantitive value in accordance with the detected field strength, and this together with the field orientation would provide a signal which enables the orientation of the die to be communicated.

It has been referred to above that a device in accordance with the invention may be used to influence the orientation in which a coin falls and comes to rest. In the case where the indicator member is a die, the application of a magnetic field above the base of the device will not force the die to land and settle in a particular orientation, but may be used to prevent any desired number from being indicated.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

What is claimed is:

1. A device comprising an indicator member comprising or carrying at least one permanent magnet element; a base whereon the indicator member can rest; means for projecting the indicator member above the base, said means comprising an electrically energizeable coil having a magnetic core with an end portion disposed in or closely beneath said base, and means for energizing said coil for projecting the indicator member by magnetic repulsion; and means for detecting the orientation in which the indicator member rests on the base.

2. A device according to claim 1 wherein said base is of upwardly facing concave configuration, and said core end portion lies at or adjacent a lowermost part thereof.

3. A device according to claim 1 further comprising means for constraining the indicator member when it is projected above the base, to prevent escape of the indicator member.

4. A device according to claim 3 wherein said means for constraining the indicator member comprises a wall or walls extending upwardly from said base.

5. A device according to claim 4 wherein said wall or walls is/are at least partially transparent.

6. A device according to claim 4 further comprising a cover member at an uppermost part of the wall or walls.

7. A device according to claim 1 wherein said indicator member is of non-ferrous material and receives at least one permanent magnet element.

8. A device according to claim 1 wherein said indicator member is a coin member.

9. A device according to claim 8 wherein said coin member has the appearance of a standard currency coin.

10. A device according to claim 1 wherein said indicator member is of cubic form.

11. A device according to claim 10 wherein said indicator member is a die.

12. A device according to claim 1 wherein said means for detecting the orientation of the indicator member when resting on the base comprises means for detecting the polarity of the magnetic field of the indicator member.

13. A device according to claim 12 wherein said detecting means is able to detect the strength of said magnetic field.

14. A device according to claim 12 wherein said detecting means comprises a Hall effect sensor disposed in association with said core of the coil.

15. A device according to claim 1 comprising means for causing electrical energization of said coil in response to the detected orientation of the coin member, to cause projection of the coin member above the base.

16. A device according to claim 15 comprising means for connecting said coil to an alternating current electrical supply at a suitable point in the cycle to cause energisation thereof in the appropriate sense.

17. A device according to claim 1 comprising means for energizing said coil to create a polarized magnetic field above the base to influence the orientation in which the indicator member comes to rest on the base.

* * * * *